US011993995B2

(12) United States Patent
Al-Mousa et al.

(10) Patent No.: US 11,993,995 B2
(45) Date of Patent: May 28, 2024

(54) TUBULAR CUTTING AND FISHING TOOL

(71) Applicant: SAUDI ARABIAN OIL COMPANY, Dhahran (SA)

(72) Inventors: Ahmed A. Al-Mousa, Doha (SA); Bader M. Al-Ahmad, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/823,424

(22) Filed: Aug. 30, 2022

(65) Prior Publication Data

US 2024/0068316 A1 Feb. 29, 2024

(51) Int. Cl.
*E21B 31/18* (2006.01)
*E21B 29/00* (2006.01)

(52) U.S. Cl.
CPC ..... *E21B 31/18* (2013.01); *E21B 29/002* (2013.01)

(58) Field of Classification Search
CPC ..... E21B 33/14; E21B 29/002; E21B 29/005
See application file for complete search history.

(56) References Cited

U.S. PATENT DOCUMENTS 2,313,263 A 3/1943 Rea
3,752,232 A * 8/1973 Bell ..... E21B 33/14 166/242.6
5,318,115 A * 6/1994 Rouse ..... E21B 4/02 166/55.7
6,029,745 A * 2/2000 Broussard ..... E21B 31/18 166/55.7
7,810,553 B2 10/2010 Cruickshank et al.
2003/0234104 A1* 12/2003 Johnston ..... E21B 34/10 166/55.7
2008/0236828 A1* 10/2008 Fuhst ..... E21B 29/005 166/55.6
2019/0169946 A1* 6/2019 Bellicard ..... E21B 17/06

FOREIGN PATENT DOCUMENTS

CN 202381009 U 8/2012

* cited by examiner

*Primary Examiner* — Christopher J Sebesta
(74) *Attorney, Agent, or Firm* — Osha Bergman Watanabe & Burton LLP

(57) ABSTRACT

A system includes an overshot body, an engagement mechanism, a cutter body, a disk assembly, and a motor. The overshot body has an overshot conduit. The overshot conduit is configured to receive the external circumferential surface of the tubular body. The engagement mechanism is disposed within the overshot conduit, connected to the overshot body, and configured to engage with the external circumferential surface of the tubular body. The cutter body is connected to the overshot body and is configured to enter the tubular conduit. The disk assembly is rotatably connected to the cutter body. The motor is located within an orifice of the cutter body and is configured to rotate the disk assembly.

10 Claims, 9 Drawing Sheets

TUBULAR CUTTING AND FISHING TOOL

BACKGROUND

Hydrocarbon fluids are often found in hydrocarbon reservoirs located in porous rock formations below the surface of the Earth. Wells are drilled into the reservoirs to access and produce the hydrocarbons. A well is drilled by running a drill string, having a drill bit and a bottom hole assembly, into a wellbore to break the rock and extend the depth of the wellbore. Multiple wellbores may be drilled from the same surface location using different size diameter drill bits. Each wellbore is supported by a casing string cemented in place. After all the wellbores are drilled and all the casing strings are cemented in place, the well may be completed. A completed includes a semi-permanent production string that has been run and set in the well to aid in producing the hydrocarbons. The production string may include production equipment such as production tubing, packers, pumps, etc.

In drilling operations, the drill string may become stuck. A stuck drill string, commonly called "stuck pipe", occurs when the drill string cannot be moved up or down the wellbore without excessive force being applied. When trying to free the stuck pipe, a portion of the drill string may be intentionally or unintentionally broken off and left in the wellbore. Further, in completed wells that are being decompleted for workover operations, the production string may also become stuck in the well. The portion of the drill string or production string that is left in the well is called a fish. In order for operations to continue on the well, a fishing operation may be performed to retrieve the fish from the wellbore. Conventional fishing operations are completed in a myriad of ways depending on the scenario presented downhole.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments methods and systems/apparatuses for interaction with a tubular body having an external circumferential surface and a tubular conduit. The system includes an overshot body, an engagement mechanism, a cutter body, a disk assembly, and a motor. The overshot body has an overshot conduit. The overshot conduit is configured to receive the external circumferential surface of the tubular body. The engagement mechanism is disposed within the overshot conduit, connected to the overshot body, and configured to engage with the external circumferential surface of the tubular body. The cutter body is connected to the overshot body and is configured to enter the tubular conduit. The disk assembly is rotatably connected to the cutter body. The motor is located within an orifice of the cutter body and is configured to rotate the disk assembly.

In accordance with one or more embodiments, the method includes providing a fishing tool comprising an overshot body having an overshot conduit, an engagement mechanism disposed within the overshot conduit and connected to the overshot body, a cutter body connected to the overshot body, a disk assembly rotatably connected to the cutter body, and a motor located within an orifice of the cutter body and configured to rotate the disk assembly. The method also includes running the fishing tool into the well, lowering the cutter body and the disk assembly into the tubular conduit of the tubular body until the tubular body enters the overshot conduit, and cutting the tubular body using the disk assembly. The method further includes activating the engagement mechanism to engage with the external circumferential surface of the tubular body and pulling a severed portion of the tubular body from the well using the fishing tool.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
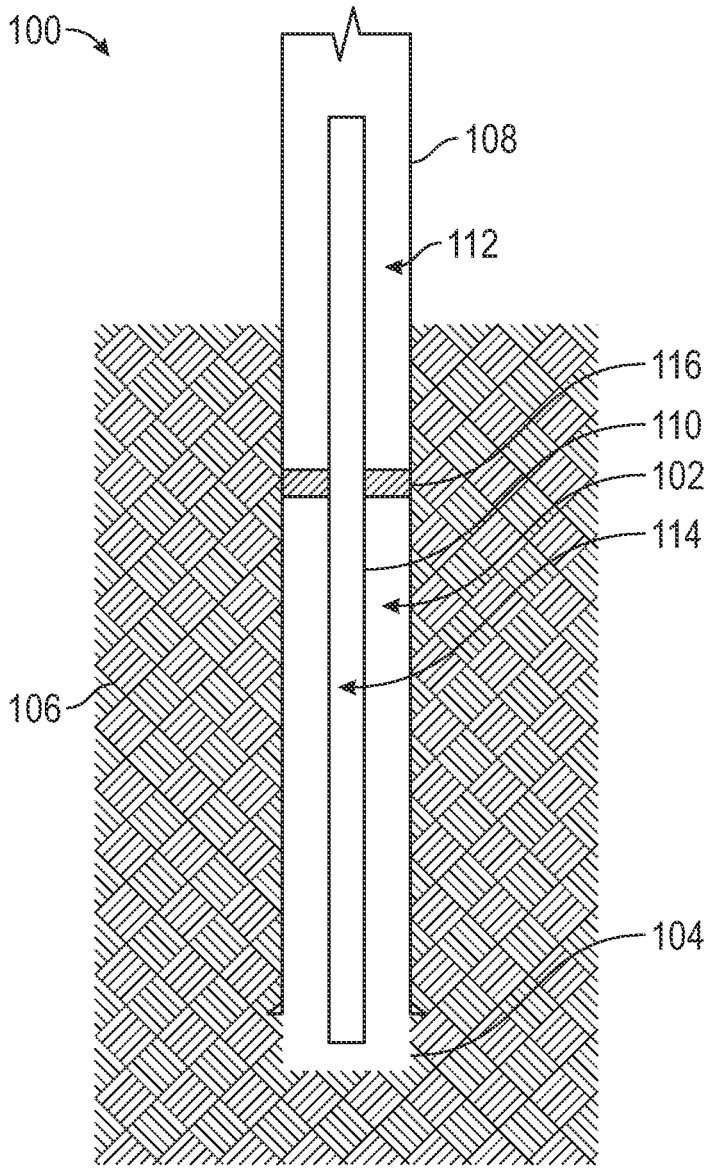
FIG. 1 shows a cross section of a tubular body disposed in a well in accordance with one or more embodiments.

FIG. 1 shows a downhole scenario where a fish is left in a well (100). Specifically, FIG. 1 shows a cross section of a tubular body (102) disposed in a well (100) in accordance with one or more embodiments. The well (100) includes a wellbore (104) drilled into a formation (106). The formation (106) may be any formation in the surface of the Earth, and, in accordance with one or more embodiments, the formation may have a hydrocarbon reservoir.

The wellbore (104) is the hole that results from a drill bit breaking down the rock of the formation (106) and the rock cuttings being removed from the well (100). A casing string (108) is cemented in the wellbore (104). The casing string (108) may be cemented to the surface, or the casing string (108) may be partially cemented in place. The casing string (108) is cemented in a wellbore (104) by pumping and setting cement in the space between the casing string (108) and the wellbore (104).

A casing string (108) is a plurality of casing joints that have been connected to one another, typically through a threaded connection. The casing joints are large diameter pipes made out of a durable material, such as a steel alloy. The casing string (108) may also include cementing-related equipment, such as centralizers, float shoes, float valves, wiper plugs, etc. A casing string (108) is used to isolate different formations (106) from one another as well as support the wellbore (104).

The casing string (108) may be the only casing string located in the well (100). However, one or more shallower casing strings (not pictured) may be cemented in the well (100) without departing from the scope of the disclosure herein. Further, the well (100) may have a liner rather than the casing string (108) without departing from the scope of the disclosure herein. The casing string (108) extends to the surface whereas a liner does not extend to the surface and is set within a shallower casing string or liner.

FIG. 1 shows an open hole portion of the wellbore (104) exposed to the tubular body (102). However, the casing string (108) may be completed across the entirety of the wellbore (104). The casing string (108), or liner, may have a solid wall or the wall may have a plurality of holes resulting in slotted casing or slotted liners. Perforations may be made in the solid wall of the casing string (108) to access the formation (106).

The casing string (108) shown in FIG. 1 may be a production casing string. A production casing string is the innermost and deepest casing string set in the well (100). The tubular body (102) has an external circumferential surface (110) that delineates an annulus (112) between the tubular body (102) and the casing string (108). The tubular body (102) has a tubular conduit (114) running through the inside of the tubular body (102). The tubular conduit (114) may be used to allow production fluids to migrate to a surface location from the formation (106). In other embodiments, the tubular conduit (114) may be used to transport drilling fluid into the wellbore (104) to aid in a drilling operation.

In accordance with one or more embodiments, the tubular body (102) shown in FIG. 1 is a production string. However, the tubular body (102) may be any other tubular body that may be left or stuck in a well (100), such as a drill string, without departing form the scope of the disclosure herein. A production string includes a plurality of production tubing joints connected to one another, typically by a threaded connection.

Production equipment, such as packers (116), pumps, sand separators, etc., may be connected to the production tubing. The production equipment may be connected to the production tubing through any means known in the art, such as welded connections or threaded connections.

FIG. 1 shows the tubular body (102) having a packer (116) activated in the annulus (112) between the tubular body (102) and the casing string (108). The tubular body (102) shown in FIG. 1 has been left behind in the well (100) meaning that something has occurred to disconnect the tubular body (102) from the surface.

In the scenario presented in FIG. 1, the packer (116) has malfunctioned, and the production string is unable to be removed from the well (100) using conventional methods. In accordance with one or more embodiments, a portion of the tubular body (102) located above, or up hole from, the packer (116) has been backed off and removed from the well (100). This leaves the tubular body (102) in the well (100) as a fish.

In order for the remainder of the tubular body (102) to be removed from the well (100), a fishing operation may be performed. Conventional fishing operations for the present scenario require multiple trips into the well to deploy several different pieces of fishing equipment that are used to cut and remove the stuck portion of the tubular body (102).

Having to perform multiple fishing trips is time consuming and presents situations that may become dangerous. Thus, the ability to remove a fish from a well (100) in as little trips as possible is beneficial. As such, the present disclosure outlines systems and methods that combine a cutting and a removal operation into one trip. FIG. 1 is not meant to be limiting and the present disclosure is intended to encompass to any scenario where a tubular body (102) is left in a well (100).

Figure 2:
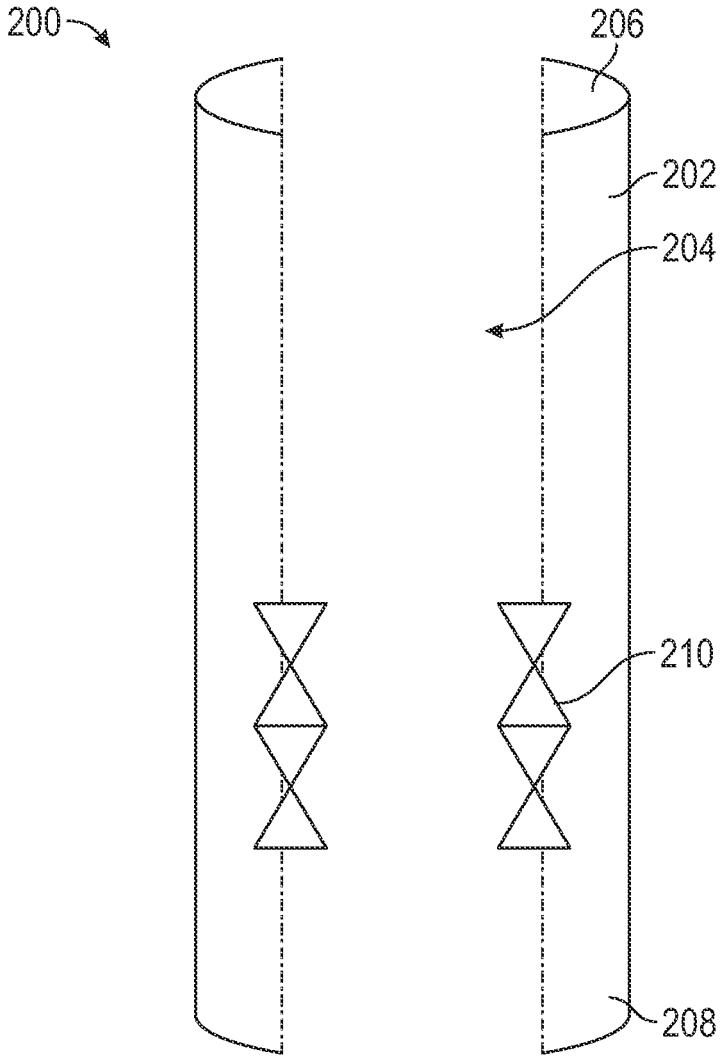
FIG. 2 shows a cross section of an overshot tool in accordance with one or more embodiments.

FIG. 2 shows a cross section of an overshot tool (200) in accordance with one or more embodiments. The overshot tool (200) includes an overshot body (202) and an overshot conduit (204). The overshot conduit (204) is a hole that extends through the center of the overshot body (202). The overshot body (202) may be made out of any material known in the art, such as a steel alloy.

The overshot tool (200) has an overshot first end (206) and an overshot second end (208). The overshot first end (206) and the overshot second end (208) are opposite one another along the overshot conduit (204). An engagement mechanism (210) is disposed within the overshot conduit (204) and is connected to the overshot body (202).

The engagement mechanism may be any mechanism that can latch onto/engage with a tubular body, such as the tubular body (102) outlined in FIG. 1. In accordance with one or more embodiments, the engagement mechanism (210) may be a grapple. A grapple includes a bowl and a grapple component.

The bowl may be machined with a helically tapered spiral section on its internal surface. The grapple component may be a spiral grapple. A spiral grapple may have an outer surface formed as a left-hand helix with a tapered end so that it engages with the helically tapered section in the bowl. In other embodiments, the grapple component may be a basket grapple. The basket grapple may be an expansible cylinder equipped with an end that engages with the helical shape of the bowl interior.

In other embodiments, the engagement mechanism may be a set of slips. A set of slips are manufactured to expand around a tubular body (102) due to the overshot tool (200) being forced on top of a tubular body (102). Once the slips are around the tubular body (102), an upward pull activates the slips to grip onto the external circumferential surface of the tubular body (102).

Figure 3:
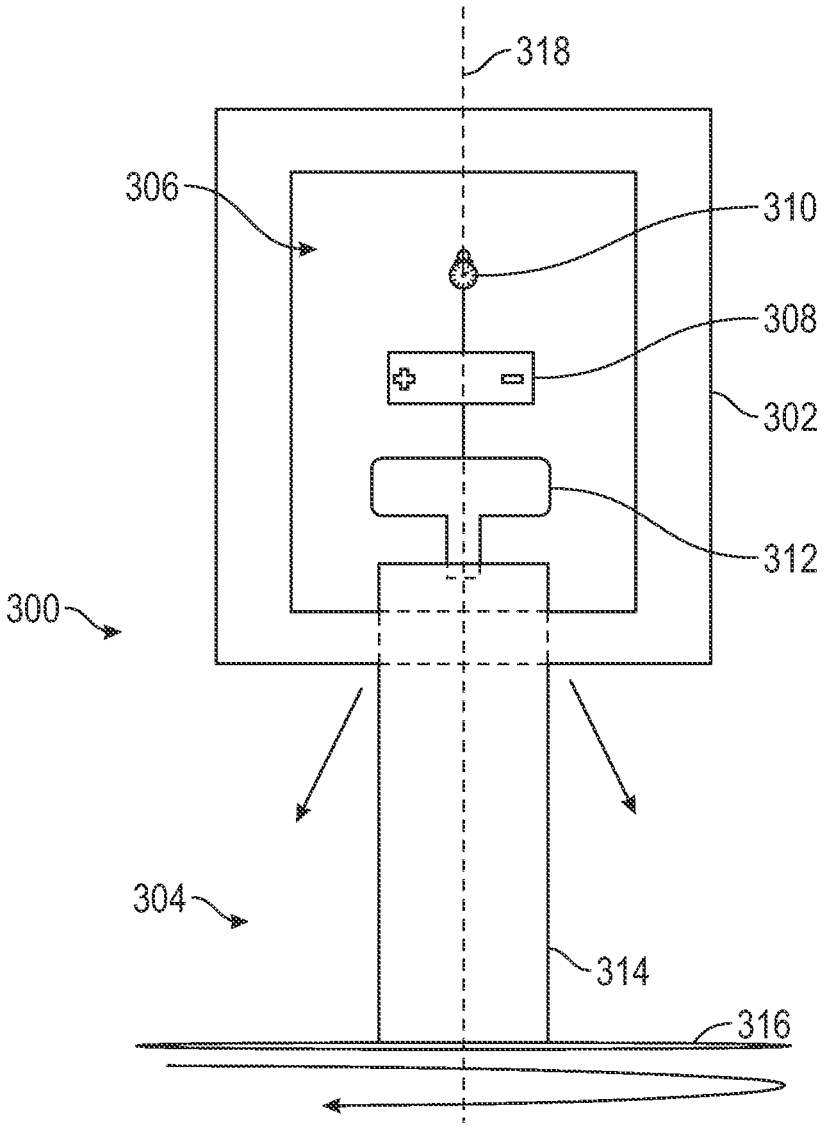
FIG. 3 shows a partial cross section of a cutter tool in accordance with one or more embodiments.

FIG. 3 shows a partial cross section of a cutter tool (300) in accordance with one or more embodiments. The cutter tool (300) includes a cutter body (302) and a disk assembly (304). The cutter body (302) has an orifice (306) located within the cutter body (302). The cutter body (302) may be made out of any material known in the art, such as a steel alloy. In accordance with one or more embodiments, a timer (308), battery (310), and a motor (312) are disposed within the orifice (306).

The timer (308) is electronically connected to the battery (310) and the battery (310) is electronically connected to the motor (312). In further embodiments, the timer (308) is a part of the battery (310). The timer (308), battery (310), and motor (312) may be fixed to various surfaces, not pictured, within the orifice (306) without departing form the scope of the disclosure herein.

The disk assembly (304) includes a connection pipe (314) and a disk blade (316). The disk assembly (304) is rotatably connected to the cutter body (302) through the connection pipe (314). The connection pipe (314) may be solid or hollow and may be made out of any material known in the art, such as a steel alloy. The disk blade (316) is a blade that is made out of a material strong enough to cut through a durable material, such as the tubular body (102). The disk blade (316) is shown as a singular blade; however, the disk blade (316) may have any design and any number of individual blades without departing form the scope of the disclosure herein.

Specifically, and in accordance with one or more embodiments, the connection pipe (314) extends through the cutter body (302) into the orifice (306) and is connected to the motor (312). The motor (312) rotates the connection pipe (314) which, in turn, rotates the disk blade (316). The motor (312) may be any motor that can be powered by electricity. In accordance with one or more embodiments, the motor (312) is an adjustable head motor.

An adjustable head motor (312) not only allows the disk assembly (304) to rotate about an axis (318) parallel to the length of the connection pipe (314) and along the centerline of the cutter body (302), but the adjustable head motor (312) also allows disk assembly (304) to move away from the axis (318) at various angles. The rotation and the movement of the of the disk assembly (304) are represented by arrows in FIG. 3. The disk assembly (304) is shown rotating in a clockwise motion, but the disk assembly (304) may rotate in any direction without departing from the scope of the disclosure herein.

As shown in FIG. 3, the motor (312) is powered by a battery (310) disposed in the orifice (306). In further embodiments, the battery (310) is programmed to power the motor (312) upon termination of a time on the timer (308). The time may be any amount of time but, specifically, may be the amount of time it takes to deploy the cutter tool (300) to a fish in a well, such as the tubular body (102) in the well (100) outlined in FIG. 1.

Figure 4:
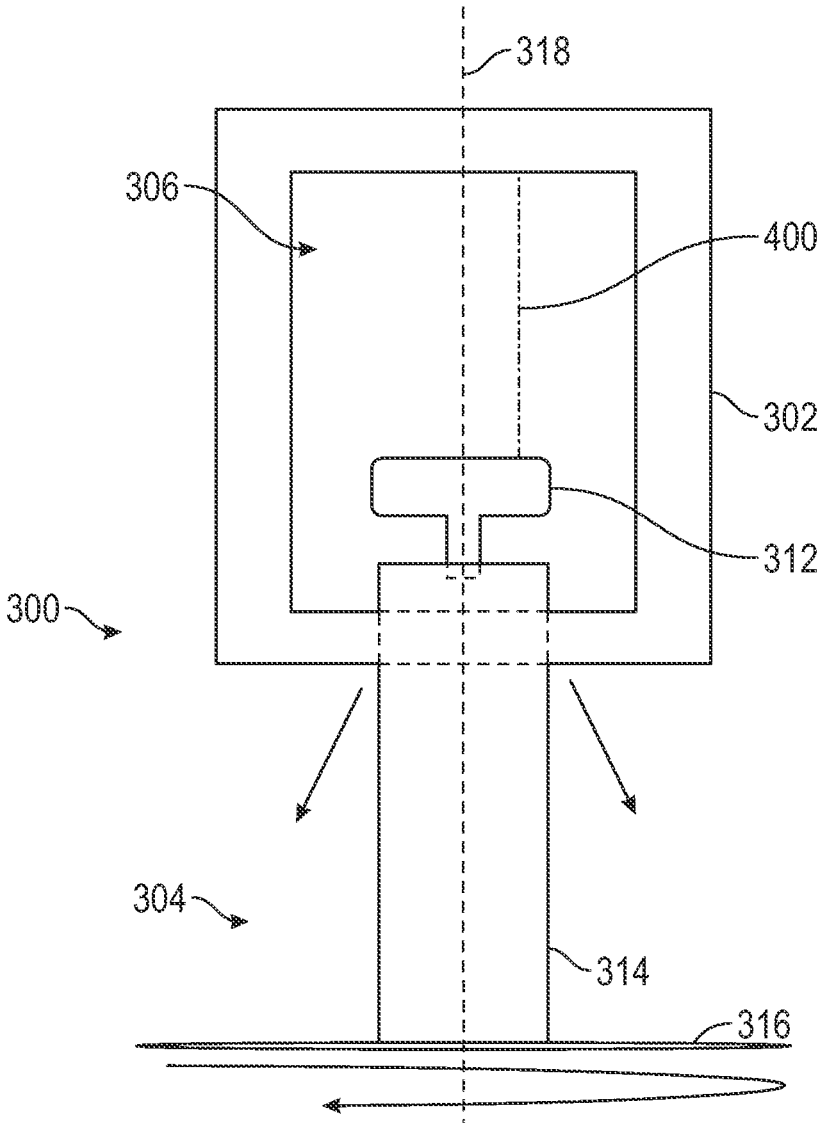
FIG. 4 shows a partial cross section of a cutter tool in accordance with one or more embodiments.

FIG. 4 shows a partial cross section of a cutter tool (300) in accordance with one or more embodiments. Components shown in FIG. 4 that are the same as or similar to components shown in FIG. 3 have not been redescribed for purposes of readability and have the same description and function as outlined above.

The cutter tool (300) shown in FIG. 4 has a cutter body (302) and a disk assembly (304) similar to the cutter tool (300) shown in FIG. 3. However, the orifice (306) shown in FIG. 4 has a motor (312) and an electrical connection (400) between the motor (312) and the cutter body (302). Electricity is transferred from an external tool or cable to the electrical connection (400) in the cutter body (302). The electricity is then transferred, using the electrical connection (400), to the motor (312). The electricity allows the motor (312) to rotate the disk assembly (304) and move the disk assembly (304) at an angle from the axis (318) of the cutter body (302).

Figure 5:
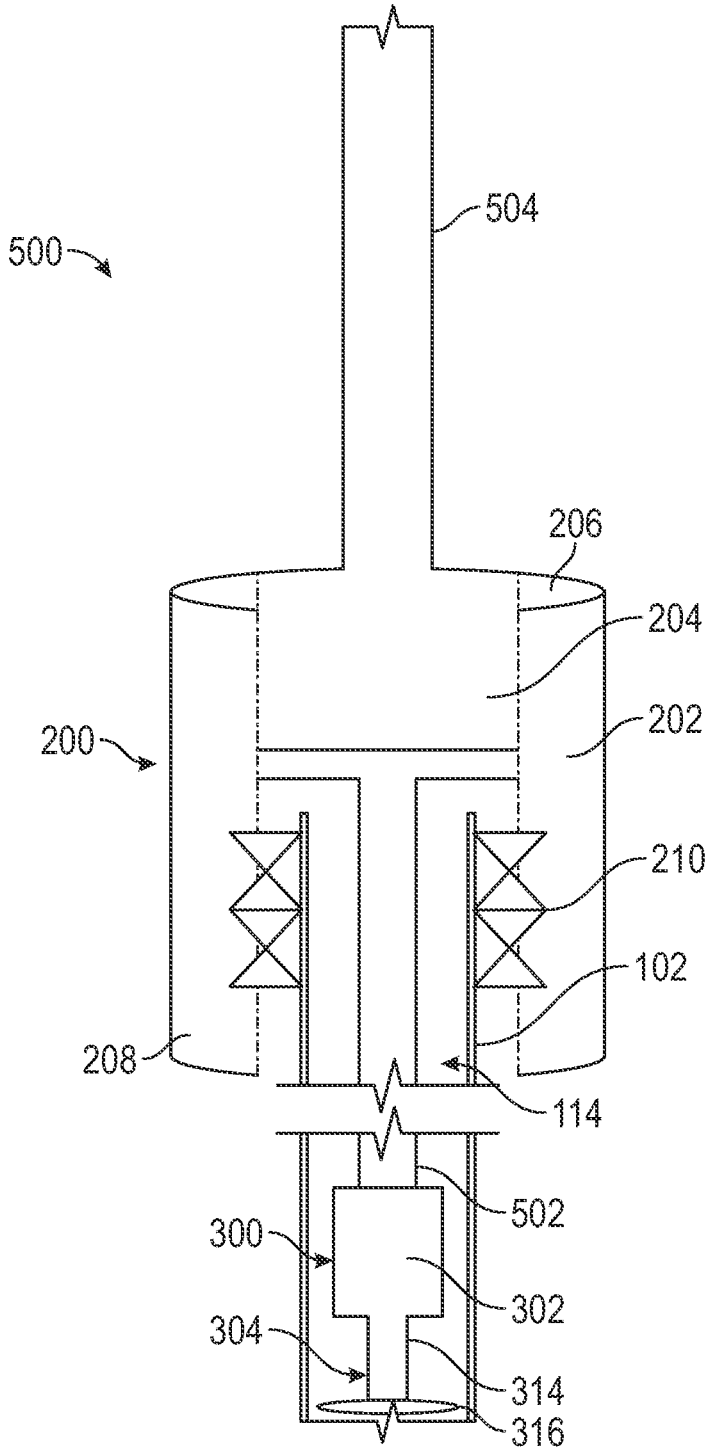
FIG. 5 shows a fishing tool interacting with the tubular body in accordance with one or more embodiments.

FIG. 5 shows a partial cross section of a fishing tool (500) interacting with a tubular body (102) in accordance with one or more embodiments. Components shown in FIG. 5 that are the same as or similar to components shown in FIGS. 1-4 have not been redescribed for purposes of readability and have the same description and function as outlined above.

The fishing tool (500) is made up of the cutter tool (300) connected to the overshot tool (200). The cutter tool (300) may be directly connected to the overshot tool (200), or the cutter tool (300) may be connected to the overshot tool (200) using one or more extension pipes (502) as shown in FIG. 5. The extension pipes (502) may be hollow or solid. The extension pipes (502) are used to create a distance between the overshot body (202) and the cutter tool (300).

The distance is determined and controlled by the number and independent length of each extension pipe (502). The extension pipes (502) may be connected to one another through any means known in the art such as through welding or through a threaded connection. The extension pipes (502) may be made out of any durable material known in the art such as a steel alloy. The distance between the cutter tool (300) and the overshot tool (200) may depend on the distance between the top of the fish and where the fish should be cut.

FIG. 5 shows the fishing tool (500) interacting with the tubular body (102) introduced in FIG. 1 in accordance with one or more embodiments. The cutter tool (300) has been inserted into the tubular conduit (114) and the overshot conduit (204) has received the tubular body (102). The fishing tool (500) may be maneuvered into/over the tubular body (102) using a deployment mechanism (504) as shown in FIG. 5.

The deployment mechanism (504) may be any deployment mechanism (504) known in the art, such as a drill string, work string, wireline, etc. The deployment mechanism (504) is connected to the overshot first end (206) and the cutter tool (300) extends from the overshot second end (208). In accordance with one or more embodiments, the cutter tool (300) is connected to the inside of the overshot tool (200) at a location up hole from the engagement mechanism (210) through the extension pipes (502), as shown in FIG. 5.

In other embodiments, the cutter body (302) may be directly connected to the inside of the overshot tool (200) at a location up hole from the engagement mechanism (210). In this configuration, the length of the connection pipe (314) is sufficient to extend the disk blade (316) out of the overshot second end (208) and into the tubular conduit (114).

The deployment mechanism (504) may be connected to the overshot first end (206) using any means known in the art, depending on the deployment mechanism. For example, if the deployment mechanism (504) is a drill string or a work string, the deployment mechanism (504) may be connected to the overshot first end (206) using a threaded connection.

If the deployment mechanism (504) is wireline, the deployment mechanism (504) may be connected to an electrical connection, similar to electrical connection (400), in the overshot first end (206). This electrical connection would extend from the overshot first end (206), through the extension pipe (502), and into the electrical connection (400) in the cutter body (302) to provide signals and electricity to the motor (312).

Figure 6A:
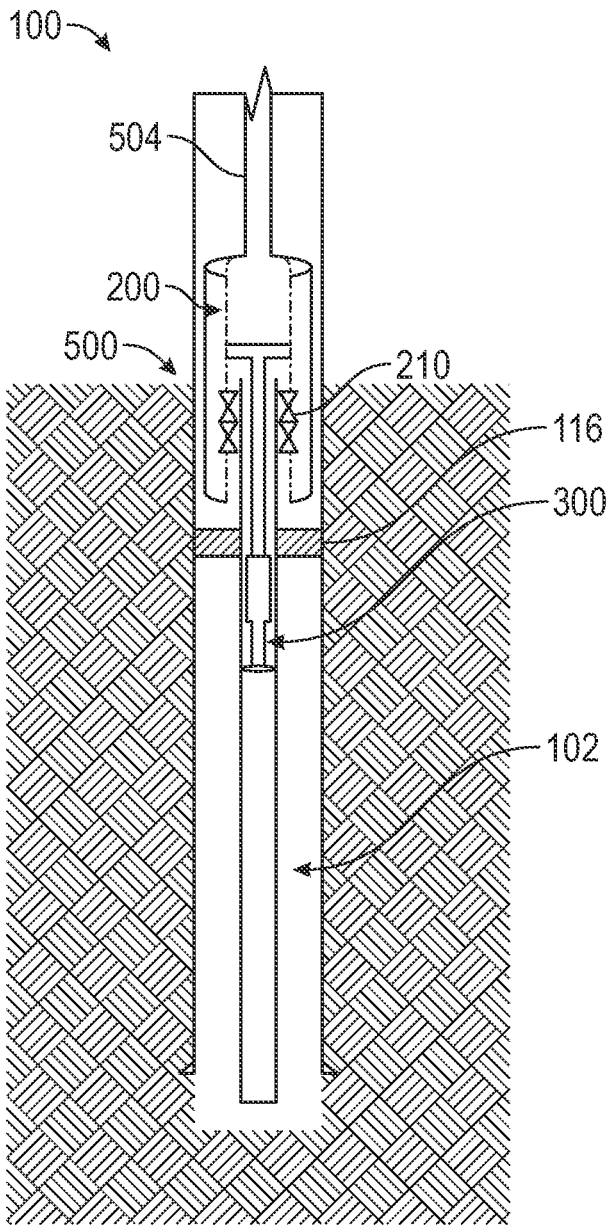
FIGS. 6A-6C show a fishing operation occurring on a well having a tubular body in accordance with one or more embodiments.
Figure 6B:
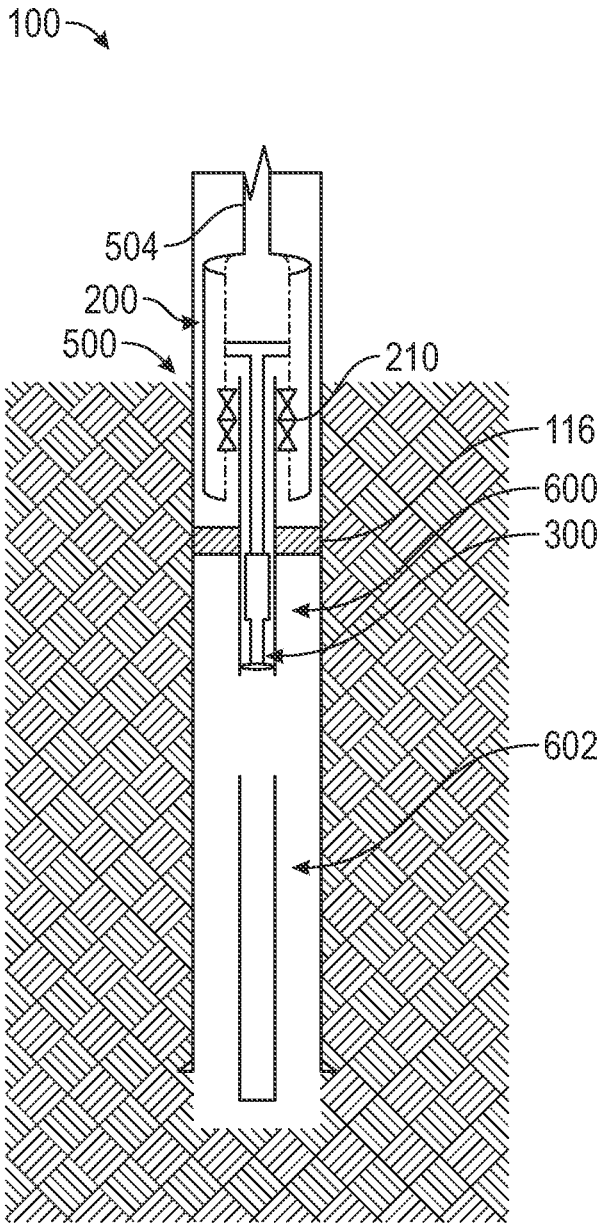
Figure 6C:
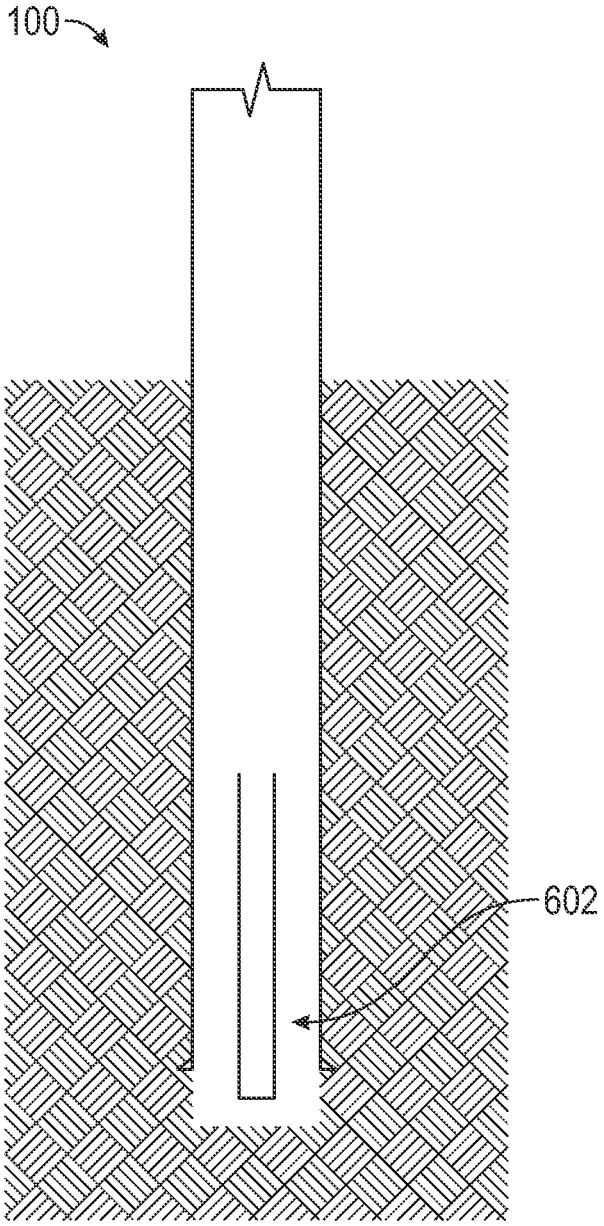

FIGS. 6*a*-6*c* show a fishing operation occurring on a well (100) having a tubular body (102) in accordance with one or more embodiments. Components shown in FIGS. 6*a*-6*c* that are the same as or similar to components shown in FIGS. 1-5 have not been redescribed for purposes of readability and have the same description and function as outlined above.

FIG. 6*a* shows the fishing tool (500) of FIG. 5 deployed in the well (100) of FIG. 1. The cutter tool (300) has entered the tubular conduit (114) and the tubular body (102) has entered the overshot conduit (204). The cutter tool (300) extends to a depth adjacent to, yet downhole from, the packer (116). The overshot tool (200) extends to a depth adjacent to, yet up hole from, the packer (116).

The cutter tool (300) is activated to rotate the disk assembly (304) about the central axis (318) of the cutter body (302). The cutter tool (300) is also activated to move the disk assembly (304) away from the central axis (318) of the cutter body (302), at an angle, in order to touch the disk assembly (304) to the walls of the tubular body (102) and make a cut into the tubular body (102). The cut in the tubular body (102) may create a severed portion (600) and a remaining portion (602) of the tubular body (102).

In accordance with one or more embodiments, the cutter tool (300) may be activated by a time on the timer (308) running out. Upon termination of the time on the timer (308), the battery (310) is permitted to supply power to the motor (312) using the battery (310). In other embodiments, the cutter tool (300) may be activated by sending a signal and power from the deployment mechanism (504), such as wireline or wired drill pipe, to the electrical connection (400) in the fishing tool (500).

Before, after, or while the cutter tool (300) cuts through the tubular body (102), the engagement mechanism (210) may be activated. The engagement mechanism (210) may be activated depending on the type of engagement mechanism (210) being used. For example, the engagement mechanism (210) may be activated by applying a weight to the tubular body (102) or by pulling up on the tubular body (102) using the deployment mechanism (504). In other embodiments, a signal sent from the deployment mechanism (504) may activate the engagement mechanism (210).

Activation of the engagement mechanism (210) causes the engagement mechanism (210) to engage with the external circumferential surface (110) of the tubular body (102). As shown in FIG. 6*b*, once the engagement mechanism (210) has engaged with the external circumferential surface (110) of the tubular body (102), the deployment mechanism (504) may be used to pull the fishing tool (500) and the severed portion (600) of the tubular body (102) out of the well (100).

As shown in FIG. 6*c*, a remaining portion (602) of the tubular body (102) may be left in the well (100). The remaining portion (602) of the tubular body (102) may be removed using another trip of the fishing tool (500) or any other retrieval tool available in the art. Further, the fishing tool (500) may be used multiple times on the same well (100) to cut multiple portions of the tubular body (102) depending on the scenario present downhole.

Figure 7:
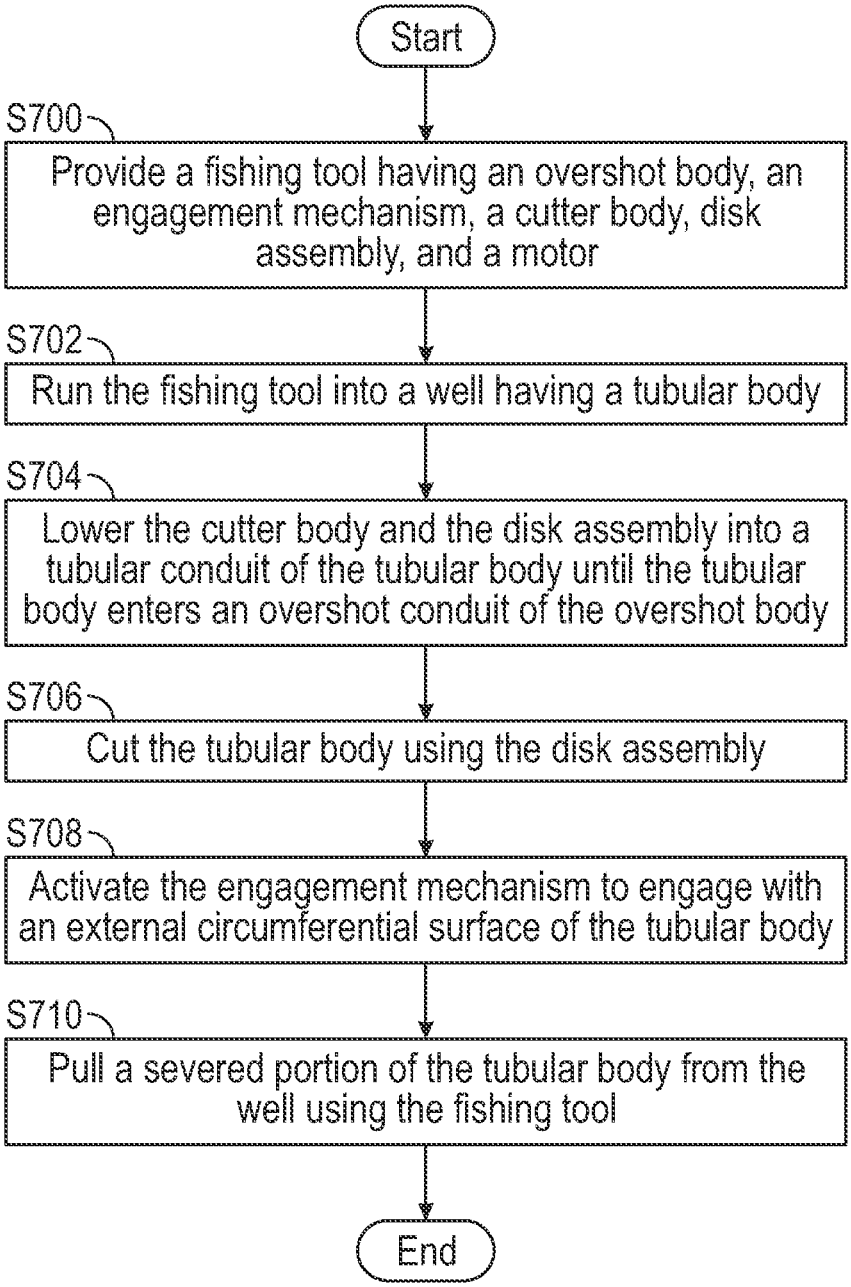
FIG. 7 shows a flowchart in accordance with one or more embodiments.

FIG. 7 shows a flowchart in accordance with one or more embodiments. The flowchart outlines a method for pulling a tubular body (102) having an external circumferential surface (110) and a tubular conduit (114) from a well (100). While the various blocks in FIG. 7 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In step 700, a fishing tool (500) is provided. The fishing tool (500) includes an overshot body (202) having an overshot conduit (204), an engagement mechanism (210) disposed within the overshot conduit (204), connected to the overshot body (202), a cutter body (302) connected to the overshot body (202), a disk assembly (304) rotatably connected to the cutter body (302), and a motor (312) located within an orifice (306) of the cutter body (302) and configured to rotate the disk assembly (304). In accordance with one or more embodiments, the cutter body (302) is connected to the overshot body (202) using one or more extension pipes (502).

In step 702, the fishing tool (500) is run into the well (100). In accordance with one or more embodiments, the overshot body (202) is connected to a deployment mechanism (504) and the deployment mechanism (504) is used to lower the fishing tool (500) into the well (100). The deployment mechanism (504) may be any deployment mechanism known in the art, such as a drill string, work string, wireline, etc. without departing form the scope of the disclosure herein.

In step 704, the cutter body (302) and the disk assembly (304) are lowered into the tubular conduit (114) of the tubular body (102). The cutter tool (300) nay be lowered to a depth where the tubular body (102) enters the engagement mechanism (210) in the overshot conduit (204) as shown in FIG. 6*a*. In step 706, the tubular body (102) is cut using the disk assembly (304).

The disk assembly (304) rotates about the axis (318) along the center of the cutter body (302). As the disk assembly (304) is rotating, the disk assembly (304) may be moved away from the axis (318), at an angle, to connected with the inner wall of the tubular body (102). This angular movement allows the disk assembly (304) to fit within the tubular conduit (114) and be able to cut the tubular body (102). In accordance with one or more embodiments, the disk assembly (304) is able to rotate and move due to an adjustable head motor (312). The motor (312) may be powered by a battery (310). The battery (310) may be activated by termination of a time on a timer (308).

In other embodiments, and when wireline or wired drill pipe is used as the deployment mechanism (504), a signal may be sent along the deployment mechanism (504) to the motor (312) to initiate rotation and movement. The motor (312) may be powered using electricity transferred from the deployment mechanism (504) to the motor (312). The signal and the electricity may be transferred between the deployment mechanism (504) and the motor (312) using an electrical connection (400) that is present within and between the cutter body (302), extension pipes (502), and overshot body (202).

In step 708, the engagement mechanism (210) is activated to engage with the external circumferential surface (110) of the tubular body (102). The engagement mechanism (210) may be activated depending on the type of engagement mechanism (210) being used.

For example, and as outlined above, the engagement mechanism (210) may be a set of slips or a grapple. Thus, the engagement mechanism (210) may be activated by applying a weight to the tubular body (102) or by pulling up on the tubular body (102) using the deployment mechanism (504). Upon engagement between the engagement mechanism (210) and the severed portion (600) of the tubular body (102), the severed portion (600) of the tubular body (102) is pulled from the well (100) using the fishing tool (500), as outlined in step 710.

A remaining portion (602) of the tubular body (102) may be left in the well (100). The remaining portion (602) of the tubular body (102) may be removed using another trip of the fishing tool (500) or any other retrieval tool available in the art.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A system for interaction with a tubular body having an external circumferential surface and a tubular conduit, the system comprising:

an overshot body having an overshot conduit, wherein the overshot conduit is configured to receive the external circumferential surface of the tubular body;

an engagement mechanism disposed within the overshot conduit, connected to the overshot body, and configured to engage with the external circumferential surface of the tubular body;

a cutter body connected to the overshot body, wherein the cutter body is configured to enter the tubular conduit;

a disk assembly rotatably connected to the cutter body; and an electric motor located within an orifice of the cutter body and configured to rotate the disk assembly, wherein the electric motor is configured to receive a signal and power from a wireline connected to the overshot body, and wherein the electric motor is electrically connected to the wireline through the cutter body.

2. The system of claim 1, wherein the cutter body is connected to the overshot body using one or more extension pipes and a distance between the cutter body and the overshot body is determined by a number and a length of the one or more extension pipes.

3. The system of claim 1, wherein the overshot body is connected to a drill string.

4. The system of claim 1, wherein the engagement mechanism further comprises a grapple.

5. The system of claim 1, wherein the engagement mechanism further comprises a set of slips.

6. A method for pulling a tubular body having an external circumferential surface and a tubular conduit from a well, the method comprising:

providing a fishing tool comprising:

an overshot body having an overshot conduit, an engagement mechanism disposed within the overshot conduit, connected to the overshot body, a cutter body connected to the overshot body, a disk assembly rotatably connected to the cutter body, and an electric motor located within an orifice of the cutter body and configured to rotate the disk assembly;

running the fishing tool into the well;

lowering the cutter body and the disk assembly into the tubular conduit of the tubular body until the tubular body enters the overshot conduit;

cutting the tubular body using the disk assembly;

activating the engagement mechanism to engage with the external circumferential surface of the tubular body; and pulling a severed portion of the tubular body from the well using the fishing tool, electrically connecting the electric motor through the cutter body with a wireline connected to the overshot body, and sending a signal and power using the wireline to the electric motor using the wireline.

7. The method of claim 6, wherein providing the fishing tool further comprises connecting the cutter body to the overshot body using one or more extension pipes.

8. The method of claim 6, wherein running the fishing tool into the well further comprises connecting the overshot body to a drill string.

9. The method of claim 6, wherein the engagement mechanism further comprises a grapple.

10. The method of claim 6, wherein the engagement mechanism further comprises a set of slips.

* * * * *